US009349271B2

(12) United States Patent
Carlsson et al.

(10) Patent No.: US 9,349,271 B2
(45) Date of Patent: May 24, 2016

(54) METHODS, USER EQUIPMENT, PROPERTY DEVICE, AND COMPUTER PROGRAM PRODUCTS FOR DETECTING MOVEMENT OF THE PROPERTY DEVICE AND OF INDICATING SUCH MOVEMENT AT THE USER DEVICE

(75) Inventors: Richard Carlsson, Stockholm (SE); Julien Forgeat, Beijing (CN); Gechuan Qiu, Guangzhou (CN)

(73) Assignee: Telefonaktiebolaget LM Ericsson (Publ), Stockholm (SE)

( * ) Notice: Subject to any disclaimer, the term of this patent is extended or adjusted under 35 U.S.C. 154(b) by 73 days.

(21) Appl. No.: 14/366,455

(22) PCT Filed: Dec. 20, 2011

(86) PCT No.: PCT/CN2011/002137

§ 371 (c)(1),
(2), (4) Date: Jun. 18, 2014

(87) PCT Pub. No.: WO2013/091133

PCT Pub. Date: Jun. 27, 2013

(65) Prior Publication Data

US 2014/0361902 A1 Dec. 11, 2014

(51) Int. Cl.
*G08B 21/00* (2006.01)
*G08B 21/18* (2006.01)
(Continued)

(52) U.S. Cl.
CPC ..... *G08B 21/18* (2013.01); *G08B 13/1427* (2013.01); *G08B 21/023* (2013.01); *G08B 21/028* (2013.01); *G08B 21/0277* (2013.01); *G08B 25/10* (2013.01); *G08B 25/009* (2013.01)

(58) Field of Classification Search
None
See application file for complete search history.

(56) References Cited

U.S. PATENT DOCUMENTS

2001/0002211 A1* 5/2001 Lee ..... H04M 1/6066 379/414
2004/0203554 A1 10/2004 Simon
(Continued)

FOREIGN PATENT DOCUMENTS

CN 101286749 A 10/2008
CN 101360306 A 2/2009
(Continued)

OTHER PUBLICATIONS

International Search Report and Written Opinion of the International Searching Authority, PCT Application No. PCT/CN2011/002137, Sep. 27, 2012.

*Primary Examiner* — Fekadeselassie Girma
*Assistant Examiner* — Thomas McCormack
(74) *Attorney, Agent, or Firm* — Patent Portfolio Builders, PLLC

(57) ABSTRACT

Short or middle range capabilities are activated at a user device, if not already active, in response to receiving a first message initiated at the property device via a wireless wide range connection. a response message, indicating that the short or middle range capabilities of the user device are active, is transmitted to the property device, via a wireless wide range connection. In response to receiving a second message initiated at the property device and indicating a failed scanning for the user device by the property device via a wireless wide range connection, an alarm indicating movement of the property device and that the property device is located out of range for the short or middle range capabilities of the user device is activated at the user device. At the property device, failed scanning processe(s) triggers the property device to initiate alarm activation at the user device.

24 Claims, 11 Drawing Sheets

(51) Int. Cl.

| | |
|---|---|
| ***G08B 13/14*** | (2006.01) |
| ***G08B 21/02*** | (2006.01) |
| ***G08B 25/10*** | (2006.01) |
| *G08B 25/00* | (2006.01) |

(56) References Cited

U.S. PATENT DOCUMENTS

| | | | | |
|---|---|---|---|---|
| 2006/0128305 | A1* | 6/2006 | Delalat | G08B 13/1418 455/41.2 |
| 2008/0143604 | A1 | 6/2008 | Mock et al. | |
| 2008/0171561 | A1* | 7/2008 | Irony | H04W 76/025 455/466 |
| 2009/0207013 | A1* | 8/2009 | Ayed | G08B 21/0277 340/539.1 |
| 2011/0021147 | A1* | 1/2011 | Tout | H04M 1/7253 455/41.2 |
| 2011/0210849 | A1 | 9/2011 | Howard et al. | |

FOREIGN PATENT DOCUMENTS

| | | | |
|---|---|---|---|
| EP | 2053573 | A1 | 4/2009 |
| GB | 2 399 440 | A | 9/2004 |

* cited by examiner

METHODS, USER EQUIPMENT, PROPERTY DEVICE, AND COMPUTER PROGRAM PRODUCTS FOR DETECTING MOVEMENT OF THE PROPERTY DEVICE AND OF INDICATING SUCH MOVEMENT AT THE USER DEVICE

CROSS REFERENCE TO RELATED APPLICATION

This application is a 35 U.S.C. §371 national stage application of PCT International Application No. PCT/CN2011/002137, filed on 20 Dec. 2011, the disclosure and content of which is incorporated by reference herein in its entirety. The above-referenced PCT International Application was published in the English language as International Publication No. WO 2013/091133 A1 on 27 Jun. 2013.

TECHNICAL FIELD

The present description relates to methods, user equipment, property device, and computer program products for detecting movement of the property device and of indicating such detected movement at the user device.

BACKGROUND

As a wide range of different types of advanced components have become cheaper and easier to produce, more user devices used in our daily lives are equipped with one or more micro processors and sensors and are also provided with connectivity capabilities enabling connectivity via wireless networks.

One way of utilizing the possibility that more and more devices can be constantly connected to the Internet, that they can be equipped with up to a multitude of sensors capable of measuring and monitoring their environment, and that they also can be able to connect to each other through various types of short or middle range radio technologies, is to use information decisive of the distance between the devices to alert its owner of unusual or unexpected situations.

Two devices, both having e.g. Bluetooth connectivity capabilities, may e.g. be configured such that one of them can detect when they become separated from each other. Such a feature has been used in Bluetooth equipped wrist watches which are capable of connecting to a users mobile phone. When such a Bluetooth connection is interrupted, due to that the wrist watch is located out of range from the mobile phone, the watch alerts the user that he/she may be about to move away from the mobile phone.

However, when a short or middle range connection, such as e.g. the Bluetooth connection mentioned above, is constantly kept on between mobile devices for the purpose of detecting when they have been separated out of range from each other, the battery of one or both of the devices will most likely be drained quickly.

In addition, many mobile devices, such as e.g. mobile phones, are not by default visible to each other, such that they can be detected as a short or middle range connectivity device, and therefore one of the devices can only be detected by the other device to determine proximity on occasions when it has actively been made visible by the user.

SUMMARY

An object of the present document is to address at least one of the problems mentioned above. More specifically, an object is to provide a method for detecting unwanted movement of a device and of initiating an alarm of such detected movement at another device without having to drain any of the devices of battery capacity, since functions involved in the detection of unwanted movement and of initiating an alarm in response to such a detection, are only activated when needed.

According to a first aspect a method executed in a user device of detecting movement of a property device is provided. The method comprise activation of short or middle range capabilities at the user device, in case such capabilities are not already active, in response to receiving a first message initiated at the property device via a wireless wide range connection. Irrespective of whether or not the short or middle range capabilities were already activated upon receiving the first message, a response message, indicating that the short or middle range capabilities of the user device are active, is transmitted to the property device, via a wireless wide range connection, and in response to receiving a second message initiated at the property device, via a wireless wide range connection, and indicating a failed scanning for the user device by the property device, an alarm indicating movement of the property device and that the property device is located out of range for the short or middle range capabilities of the user device, is activated at the user device.

According to an alternative embodiment, the response message is not only used as a trigger at the property device but it is also indicating either that the short or middle range capabilities were already active upon receiving the first message, or that the short or middle range capabilities have been activated in response to receiving the first message. Thereby, the property device will be able to use this information to determine whether a second scanning process is necessary or not, and thus the complete movement detection process can be shortened, if it is determined that it is sufficient with only one scanning process. In the latter case, battery consumption will be reduced even further.

According to another aspect, a computer program product, comprising computer readable code means and a computer readable code embedded thereon is provided, which computer readable code is configured to cause one or more processors to perform a method according any of the embodiments suggested above.

According to another aspect, a method executed in a property device of indicating movement of the property device at a user device is disclosed. Such a method is initiated by recognizing movement of the property device, at the property device. The property device is responding by initiating a first scanning for a registered user device, using short or middle range capabilities, and, in case the user device is not found during the first scanning, the property device is in a subsequent step verifying active short or middle range capabilities at the user device by transmitting a first message to the user device via a wireless wide range connection. When the property device receives a response message initiated at the user device, sent in response to the first message, and indicating that the short or middle range capabilities are active at the user device, the property device initiates a second scanning for the user device, and, in case the user device is not found during the second scanning, the property device initiates activation of an alarm at the user device by transmitting a second message to the user device, via the wireless wide range connection. Thereby the property device enables a user of the user device to be notified of a movement of the property device where the property device is out of range for the short or middle range capabilities of the user device.

According to an alternative embodiment, the second scanning is initiated at the property device and the activation of the alarm at the user device is initiated in case the user device is not found during the second scanning and in case it is also indicated in the received response message that the short or middle range capabilities of the user device were activated by the user device in response to receiving the first message at the user device. If the response message does not comprise such an indication, the activation of the alarm is instead initiated without initiating the second scanning in response to receiving the response message from the user device, and thus, in the latter case a faster completion of the method can be achieved.

According to one embodiment, the method is terminated in case the user device is found during any executed scanning, and the method is repeated upon recognizing another movement of the property device, while according to an alternative embodiment, the method is repeated only upon recognizing the initiation of at least one predefined event, prior to recognizing another movement. Such an event may e.g. be the unlocking of a mechanical or electronic lock or any other function of the property device or connected to the property device.

In addition, the property device may also activate a control mechanism to lock, disable and/or turn off at least one function of the property device, or of a device connected to the property device, in association with transmitting the second message. Thereby, the property device will not only initiate a remote alarm but will also be able to prohibit a fraudulent user of the property device, as well as any device attached to the property device, to make use of selected functionality of any of these devices.

According to yet another embodiment, the property device may repeat each scanning process initiated for a registered user device by scanning for at least one additional user device. Thereby a user may be able to selectively or simultaneously use a plurality of different user devices for keeping track of a property device.

In case the property device is connectable to more than one user device and in case more than one of these user devices are not found during the executed scanning processes, determining whether or not to initiate activation of at least one alarm at a respective user device and/or what type of alarm activation to initiate for a respective user device, may be determined on the basis of predefined prioritization rules. Thereby, a user may selectively be alerted in different ways and/or on different devices, depending e.g. on the time of the day or in which environment the user is presently located.

According to another aspect, a computer program product comprising computer readable code means and a computer program embedded thereon is provided which is configured to cause one or more processors to perform any of the methods to be executed on a property device as suggested above.

The messages may according to one embodiment be transmitted via an alarm control server which is capable of connecting to the property device and the user device. According to an alternative embodiment, the messages may instead be sent directly between the two devices, in case the two devices can communicate directly with each other without requiring any intermediate server. In the latter case a more simple solution is provided, which does not require connection to any fixed communication network.

According to another aspect, a user device capable of detecting movement of a property device is provided, where such a user device comprises a controlling unit which is configured to activate short or middle range capabilities at the user device, in case such capabilities are not already active, in response to receiving a first message initiated at the property device via a receiving unit and a wireless wide range connection. The user device responds to receiving the first message by transmitting a response message to the property device via a wireless wide range connection and a transmitting unit, where the response message is indicating that the short or middle range capabilities of the user device are active. If, after transmission of the response message, the user device receives a second message, initiated at the property device via the wireless wide range connection and the receiving unit indicating a failed scanning for the user device by the property device, it activates an alarm unit, where the alarm is indicative of a movement of the property device and of a location of the property device which is out of range for the short or middle range capabilities of the user device.

Instead of just providing a response message which is used as a trigger for initiation of a second scanning process, the controlling unit may be configured to provide a response message indicating either that the capabilities of the user device were already active upon receiving the first message, or that the short or middle range capabilities have been activated in response to receiving the first message.

According to another aspect a property device capable of indicating movement of the property device at a user device is disclosed. The property device comprises a controlling unit configured to cause a scanning unit to execute a first scanning for a registered user device using short or middle range capabilities, in response to receiving an indication of movement of the property device from a movement sensing unit. In case the user device is not found during the first scanning, the controlling device is also configured to verify that short or middle range capabilities are active at the user device by transmitting, via a transmitting unit and a wireless wide range connection, a first message to said user device and to receive, in response to the first message, via a wireless wide range connection and a receiving unit, a response message initiated at the user device, indicating that the short or middle range capabilities are active at the user device. Upon receiving the response message, the processing unit is also configured to cause the scanning unit to initiate a second scanning, and, in case the user device is not found during the second scanning, to initiate activation of an alarm at the user device by transmitting a second message to the user device via the wireless wide range connection and the transmitting unit, thereby enabling a user of the user device to be notified of a movement of the property device when the property device is out of range for the short or middle range capabilities of the user device.

The controlling unit of the property device may according to one embodiment be configured to initiate the second scanning at the property device and initiate activation of the alarm at the user device in case the user device is not found during the second scanning and in case it is indicated in the received response message that the short or middle range capabilities of the user device were activated by the user device in response to receiving the first message at the user device. Alternatively, the controlling unit may be configured to initiate activation of the alarm without initiating the second scanning in response to receiving the response message from the user device.

The controlling unit may be configured to terminate the process in case the user device is found during any executed scanning, and to repeat the process upon recognizing initiation of at least one predefine event.

Alternatively, the controlling unit may also be configured to activate a control mechanism to lock, disable and/or turn off at least one function of the property device, or of a device connected to the property device, in association with initiating activation of the alarm.

The controlling unit may be configured to repeat each initiated scanning process by initiating a scanning process for at least one additional user device.

For the event that a scanning process is repeated for a plurality of user devices and in case more than one of these user devices is not found during the executed scanning processes, the controlling unit may be configured to determine whether or not to activate an alarm for a respective user device which was not found on the basis of predefined prioritization rules.

The controlling unit may be configured either to set up the wireless wide range connection directly from the property server to a respective user device, or via an alarm control server.

According to yet another aspect a movable device may be provided with a property device according to any of the embodiments suggested above.

A user device capable of detecting movement of a property device may, at least partly comprise software related functionality. According to one embodiment a property device comprises at least one processor and a memory which is capable of storing instructions which when executed by the at least one processor causes the one or more processors to activate short or middle range capabilities at the user device, in case such capabilities are not already active, in response to receiving a first message initiated at the property device via a receiving unit and a wireless wide range connection. Instructions also causes the one or more processors to transmit a response message, indicating that the short or middle range capabilities of the user device are active, to the property device, via the wireless wide range connection and a transmitting unit in response to receiving the first message.

In response to receiving a second message initiated at the property device and indicating a failed scanning for the user device by the property device via the wireless wide range connection and the receiving unit, instructions also causes the one or more processors to cause an alarm unit to activate an alarm, indicative of movement of the property device and of a location of the property device which is out of range for the short or middle range capabilities of the user device.

According to yet another aspect, a property device capable of indicating movement of the property device at a user device is provided which comprises a processor and a memory capable of storing instructions which when executed by the processor causes the processor to cause a scanning unit to execute a first scanning for a registered user device, using short or middle range capabilities in response to receiving an indication of movement of the property device from a movement sensing unit.

In case the user device is not found during the first scanning, the processor is also caused to verify that short or middle range capabilities are active at the user device, by transmitting a first message to the user device via a transmitting unit a wireless wide range connection; to receive a response message initiated at the user device, via the wireless wide range connection and a receiving unit, in response to receiving the first message, where the response message is indicating that the short or middle range capabilities are active at the user device; to cause the scanning unit to initiate a second scanning, and, in case the user device is not found during the second scanning—to initiate activation of an alarm at the user device by transmitting, a second message to the user device via the wireless wide range connection and the transmitting unit, thereby enabling a user of the user device to be notified of movement of the property device when the property device is out of range for the short or middle range capabilities of the user device.

Further advantages and features of embodiments of the present invention will become apparent when reading the following detailed description in conjunction with the drawings.

BRIEF DESCRIPTION OF THE DRAWINGS

The objects, advantages and effects as well as features of the invention will be more readily understood from the following detailed description of embodiments of methods, a user device and a property device, as well as other aspects of the invention when read together with the accompanying drawings, in which.

DETAILED DESCRIPTION

Figure 1:
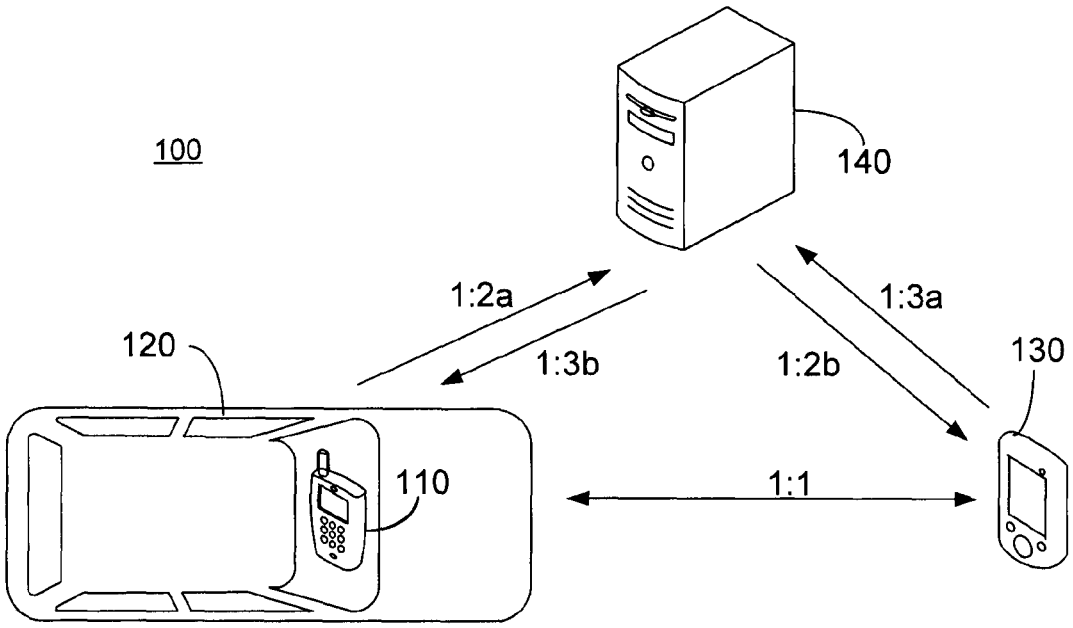
FIG. 1 shows an overview of a movement detecting system, according to one embodiment.

Below a system which enables a user of a first device, kept in close vicinity to the user to become aware of unwanted movement of a second device which is not allowed to be moved more than a limited distance away from the first user device is described. The described system is adapted such that certain functionality which is involved in the mentioned movement determination is operable only when required. In addition, methods to be executed in each of the two devices, as well as configurations of devices capable of executing the suggested methods will also be described in further detail.

While the concept described herein covers various modifications and alternative constructions, embodiments of the invention are shown in the drawings and will hereinafter be described in detail. However it is to be understood that the specific description and drawings are not intended to limit the invention to the specific forms disclosed. On the contrary, it is intended that the scope of the claimed invention includes all modifications and alternative constructions thereof falling within the spirit and scope of the inventive concept as expressed in the appended claims.

The following embodiments are exemplary. Although the specification may refer to "an", "one", or "some" embodiment(s) in several locations, this does not necessarily mean that each such reference is to the same embodiment(s), or that the feature only applies to a single embodiment. Single features of different embodiments may also be combined to provide other embodiments.

An overview of a system capable of detecting movement of a first device and of notifying the detected movement at another device, as indicated briefly above, will now be described with reference to FIG. 1, where the described system 100 comprise a device 110, from hereinafter referred to as a property device, which is capable of sensing movement of the property device 110 and arranged so that it can be attached to or placed into another device 120, in the present case a car, such that when the car 120 is moved away from yet another device, from hereinafter referred to as a user device 130, kept in close vicinity of a user, a process for determining whether or not the movement can be considered to be an acceptable movement is initiated at the property device 110. Such a process, from hereinafter referred to as a movement alarm process, will result in that functionality capable of determining whether or not the two devices are moving away from each other will be activated, if it is not already active, and, in case it is determined that a movement of the property device 110 is a non-acceptable movement, the property device 110 activates an alarm at the user device 130, such that a user of the user device 130 can become aware of the detected non-acceptable movement.

In addition to be used on or in a car, or any other type of vehicle, the device 120 on which the property device 110 is attached or placed may e.g. be a computer, including a personal computer, a lap top or a desktop, a tablet, a piece of art, a brief case, a container or practically any type of device which is movable but which, at least on certain occasions, should have certain restrictions on how to be moved. The suggested method can easily be applied on demand, such that it is enabled on occasions when restricted movement is required and disabled when restricted movement is no longer required.

The property device 110 is capable of scanning for user device 130, via a short or middle range connection 1:1, where such a scanning will result in a successful scanning, i.e. such that the user device 130 scanned for is found by the property device 110, on the condition that the two devices 110,130 are located relative to each other such that they are within range for the short or middle range connection. The two devices are also capable of communicating via wireless wide range connections 1:2a, 1:2b, 1:3a:1:3b, which may refer to a two-way connection or separate one-way connections which enables messages to be sent between the two entities, irrespective of whether the two devices 110,130 are located close to distant to each other.

As indicated in FIG. 1, the property device 110 and the user device 130 communicates via the wireless wide range connections 1:2a, 1:2b, 1:3a:1:3b via an intermediate entity, here referred to as an alarm control server 140. Alternatively, the two entities 110,130 may communicate with each other via a direct communication channel, without requiring an alarm control server 140 or any other intermediate node.

In the present context short or middle range connection is to be interpreted as a connection with local access, or more specifically a connection which is only available when the two entities are located in close vicinity of each other. How far away the two entities are allowed to be located from each other without activating any alarm will depend on the range provided by the chosen technology. The short or middle range capabilities applied on the two entities may be e.g. Bluetooth, WiFi (Wireless Fidelity), NFC (Near Field Communication), 802.14.4, DSRC (Dedicated Short Range Communications) or IR communication (Infra Red Communication), or any other type of communication technique, providing wireless communication between the two entities in such a way that it can be detected when the two entities are out of range of each other. The suggested wireless wide range connection on the other hand is to be referred to as a cellular connection which can provide relatively reliable connectivity which can be maintained between the two devices 110,140 also when the short or middle range capabilities applied on the two devices 110,130 are out of range of each other. The wireless wide range connection may be e.g. GSM (Global System for Mobile Communication), 3G or any other type of long range, cellular communication technique which is providing practically full coverage in the monitored area.

Although either short or middle range capabilities may be applied for the described scanning purposes, this task will consequently be described and exemplified by use of short range capabilities in the following examples.

Figure 2:
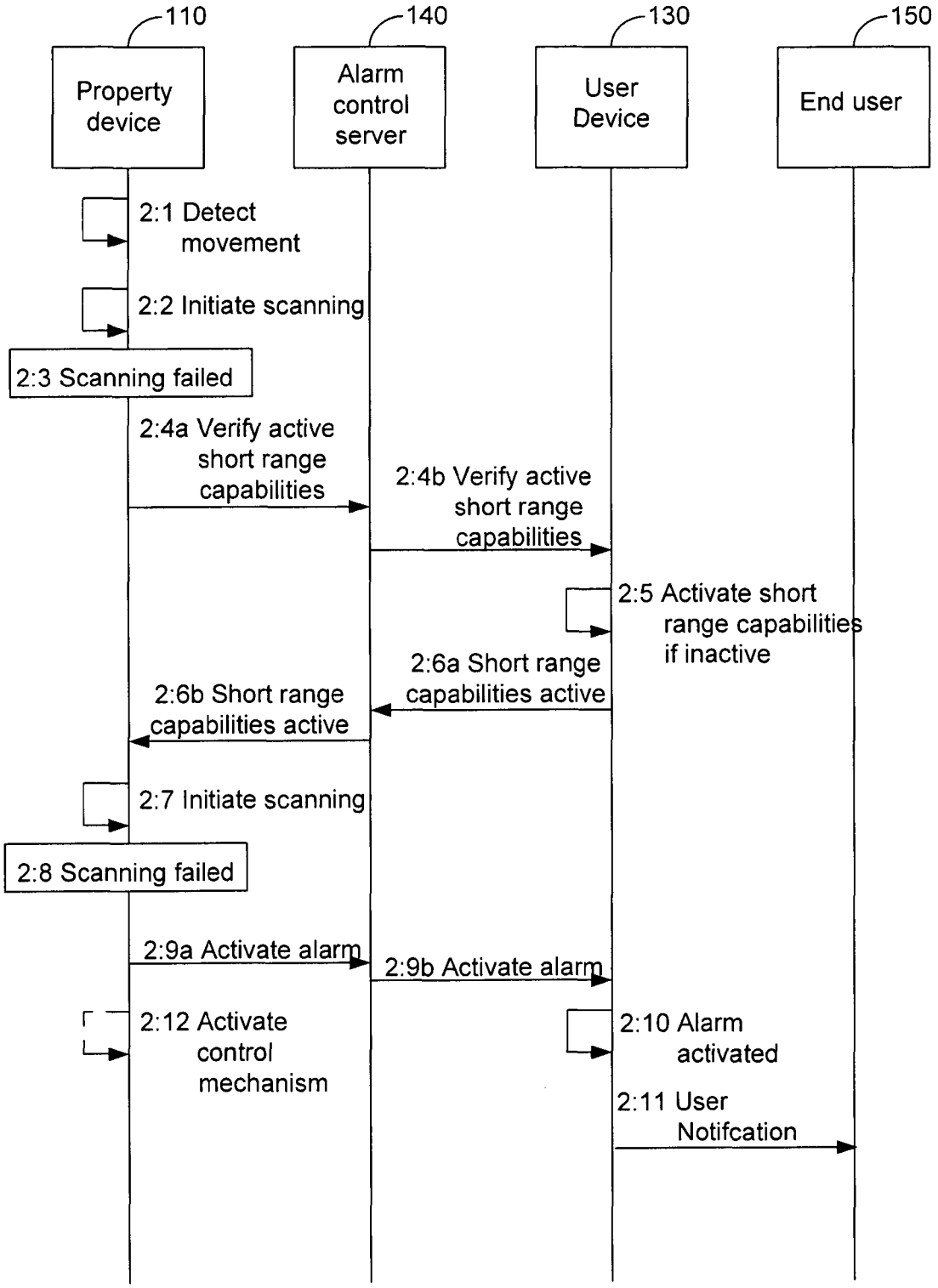
FIG. 2 is a signaling diagram illustrating how an end user of a user device can be notified of a movement of a property device, according to one embodiment.

The process mentioned in short above can be described in further detail with reference to FIG. 2, where the process is initiated at a property device 110, by the property device 110, being arranged on or within a movable device (not shown), detecting movement of the movable device and the property device 110, as indicated in a first step 2:1. For the purpose of detecting movement, a device such as e.g. an accelerometer, a GPS, a gyrometer, a magnetometer, or any type of device capable of detecting movement and configured to be implemented on or connected to the property device 110 may be used and adjusted to an appropriate accuracy. How to adjust the accuracy of the movement detector is however out of scope of this document. Thereby, the property device 110 will be able to detect movement whenever the property device 110 is moved from its present location. A movement detected by the property device 110 results in an initiation of a scanning procedure at the property device 110, as indicated in a next step 2:2. More specifically the scanning procedure includes a scanning for a user device 130 registered in advance at the property device 110. Although a scanning for only one user device 130 is illustrated in FIG. 2, the property device 110 may alternatively be configured to scan for a plurality of user devices registered to it, upon recognizing movement of the property device 110. In the latter case, a separate process commencing from step 2:2 to step 2:9*b* will be executed for each user device in parallel, as will be further explained below with reference to FIG. 5*c*.

Each scanning process will continue for a pre-determined time interval. If a scanning for a user device is successful, i.e. each user device which has been scanned for is found within the predefined time interval, the process initiated in step 2:1 is terminated, since at that stage the two devices are obviously within range from each other and, thus, the detected movement is within allowed range of the user device 110. Typically, detection of a new movement will initiate a new scanning process, i.e. the process of FIG. 2 will start all over again, starting with execution of step 2:1.

In case of a plurality of user devices registered at the property device 110, the process will typically not be terminated until all registered user devices have been scanned for. If all registered user devices are found during scanning, all of these user devices are obviously located within range of the short range functionality used for the scanning, and, thus, the registered movement is considered as a movement acceptable by the user. However, in case at least one scanning fails, as indicated with step 2:3, the process initiated at step 2:1 continues. At this stage one can only verify from the failed scanning that the property device 110 has not been able to establish contact with at least one registered user device, in the present example exemplified with user device 130, within the pre-determined time interval allowed for the scanning.

In order to assure that the property device can rely on the result of a scanning, the property device 110 therefore has to verify that short range capabilities are active at the user device 130 when the scanning is executed. Therefore, a failed scanning triggers a transmission of a message from the property device 110 to the user device 130, as indicated in another step 2:4*a*. In the present example the message is sent to the user device 130 via an intermediate node, referred to as an alarm control node 140, which is forwarding the message to the user device 130 in a subsequent step 2:4*b*. The alarm control server 140, which may e.g. be based on the Java EE (Enterprise Edition) platform, may typically comprise an application which is configured to recognize messages received from the property device 110 and corresponding response messages received from the user device 130 and to forward such messages to the respective other device accordingly by applying some type of long range communication technique.

It is to be understood, that conventional access nodes which normally may be used in wireless communication systems to provide access to functional nodes or servers have been omitted in FIG. 2 for simplicity reasons. It is also to be understood that, alternatively the wireless communication may be possible to set up between the property device 110 and the user device 130 without requiring any participation from an intermediate node. In the latter case a direct communication between the property device 110 and the user device 130 may instead be established by the property device 110, and, thus, steps 2:4*a* and 2:4*b* will be replaced by one single step 2:4 (not shown).

At the user device 130 the received message results in the user device 130 activating its short range capabilities, in case these capabilities are not already active, as indicate in a step 2:5. In case the short range capabilities are already active, upon receiving the message in step 2:4*b* (or step 2:4 in case of a direct communication) the process continues with transmitting a response message to the property device 110, as indicated in step 2:6*a* and 2:6*b*, or directly to the property device in an alternative step 2:6 (not shown), in case no alarm control server or any other corresponding intermediate node is required.

Irrespective of whether the short range capabilities were already active upon receiving the message by the user device 130, or whether the message received in step 2:4*b* resulted in the activation of the short range capabilities, as indicated in step 2:5, a response message is generated by the user device 130 and transmitted to the property device 110.

The messages mentioned above may be provided e.g. as SMS, GPRS data packet, 3G data packet, or in any other form available by the applied long range communication technology, as long as the messages can be used for instructing the respective terminating device to perform a respective required activity.

The property device 110 will interpret the received response message as an indication that the short range capabilities of the user device 130 are now definitely active and, thus, if a repeated scanning for user device 130 also fails, the property device 110 will be able to verify that it has been moved out of range for the short range capabilities of the user device 130, and, thus, out of the allowable range from the user device 130. Another scanning for the user device 130 is therefore repeated in a next step 2:7.

Similar to the previous scanning executed in step 2:3, the scanning process will be terminated once the user device 130 scanned for is found, since if so, the movement registered by the property device is verified by the second scanning process as a movement within allowed range of the user device 130.

If, on the other hand, the second scanning fails for at least one user device, as indicated in step 2:8, the property device 110 responds by activating an alarm at the user device 130. This is achieved by generating a message, which could be referred to as an alarm activation message, containing such an instruction and by transmitting the generated message to the user device 130, once again by using a wireless wide range connection available between the property device 110 and the user device 130. Such an alarm activation message is sent in steps 2:9*a* and 2:9*b*, which again may be replaced by a direct step 2:9 if no alarm control server is applied. An alarm is activated by the user device 130 in response to receive the alarm activation message, as indicated in a subsequent step 2:10.

The alarm activation may include activation of any type of audio and/or visual means, alone or in a combination, which is available at the user device 130, at a device connected to the user device 130, or at a combination thereof. In any event, an alarm arrangement which is capable of alerting a user of an unwanted movement is made perceptible to a user of user device 130, as indicated in a subsequent step 2:11. The alarm may e.g. include an audio signal, possibly in combination with a text message presented on a conventional display, an identity or any other indication, indicating which property device that has been moved.

As an optional feature, the property device 110 may be configured such that, in addition to initiate activation of an alarm at a user device 130, it also activates a control mechanism on the property device 110, or another device connected to the property device 110, to lock, disable and/or turn off one or more functions of the property device 110 and/or the connected device. By inactivating parts of, or the complete property device 110 or attached device, it may be of no use to a person who, without permission, has moved it from its intended location. In case the property device 110 is located within a car or any other motor vehicle, the ignition of the vehicle may e.g. be disabled, prohibiting the vehicle from being started. In FIG. 2 such a feature is executed in an optional step 2:12. A locked function may according to one embodiment only be able to unlock e.g. by entering a specific code to the property device 110 or by performing any other type of secure re-activation procedure on property device 110 or an attached device, as the case may be.

Figure 3A:
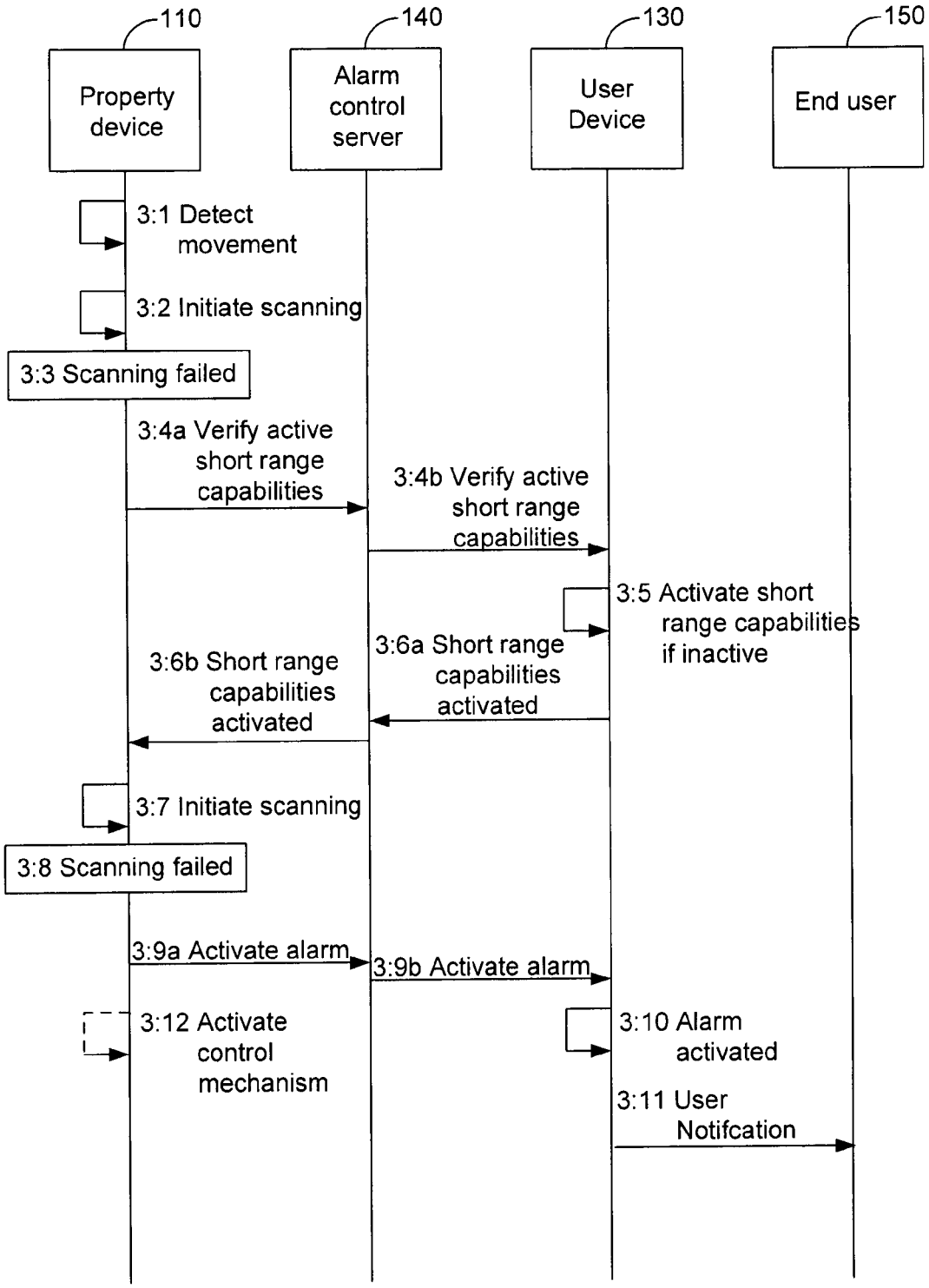
FIGS. 3*a* and 3*b* are signaling diagrams illustrating in two different scenarios how an end user of a user device can be notified of a movement of a property device, according to another embodiment.
Figure 3B:
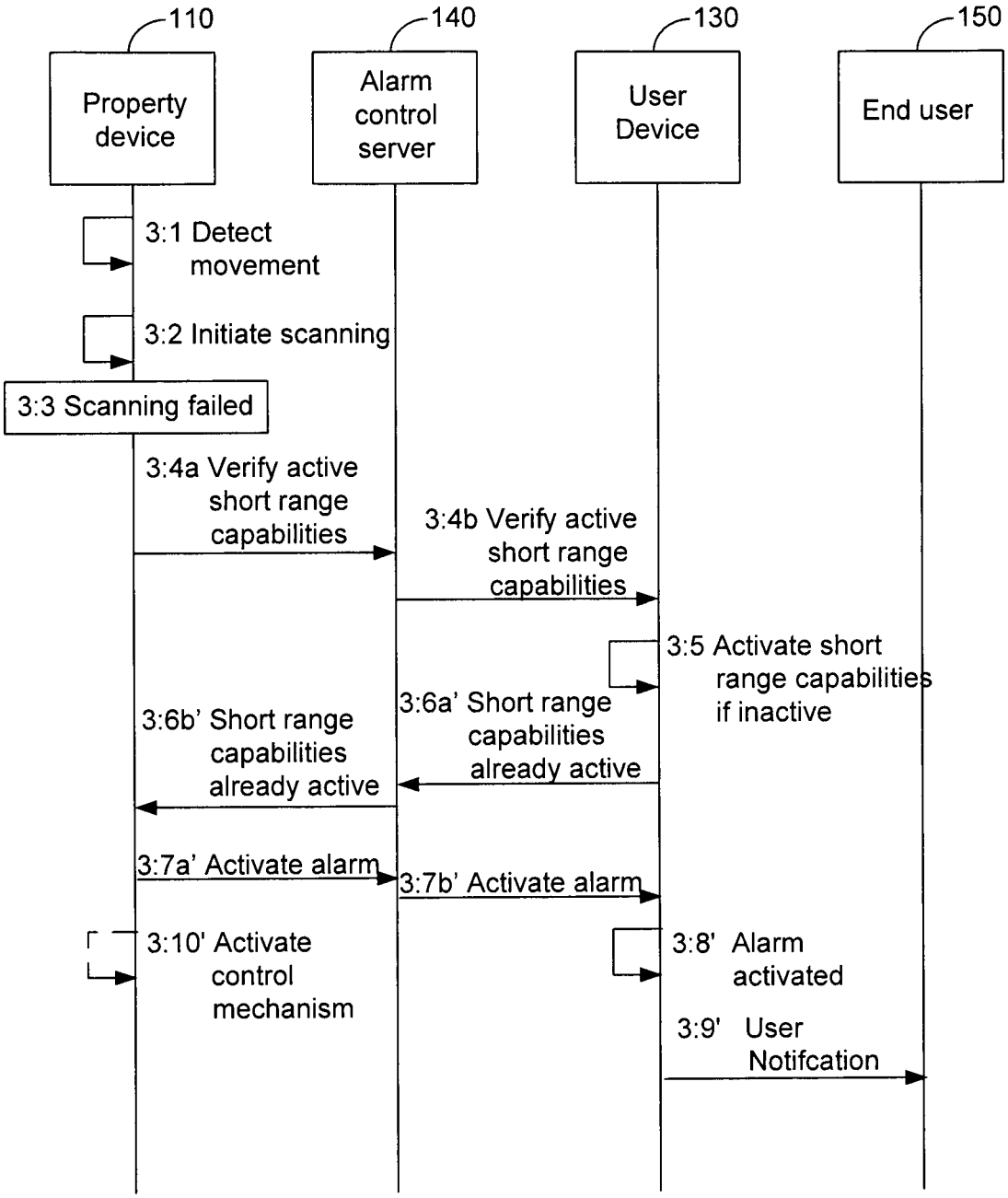

According to an alternative method, which is illustrated in FIG. 3*a* and FIG. 3*b*, the user device 130 may be configured to provide more detailed information to the property device 140 in response to receiving a message from the user device 110, as indicated with steps 3:6*a* and 3:6*b* of FIG. 3*a* or steps 3:6*a*' and 3:6*b*' or FIG. 3*b*, or 3:6' in case of direct communication between the property device 110 and the user device 130, whereby the user device 130 indicates in the response message whether the short range capabilities were already active when receiving the first message, or whether they were activated in response to receiving the message from the property device 110. Thereby the property device 110 will be made aware of whether the conditions for a successful scan were fulfilled already for the first scanning, and, in such a case, a second scanning will not be necessary.

Steps 3:1-3:5 in FIGS. 3*a* and 3*b* corresponds to steps 2:1-2:5 in FIG. 2, while steps 3:6*a* and 3:6*b* of FIG. 3*a* and 3:6*a*' and 3:6*b*' of FIG. 3*b*, respectively, refer to more detailed messages than the corresponding messages sent in steps 2:6*a* and 2:6*b*.

If, as indicated in FIG. 3*a*, the property device 110 is informed in step 3:6*b* that the short range capabilities of the user device 130 were activated in response to receiving message 3:4*b*, the same procedure as in FIG. 2 is executed, i.e. a second scanning is initiated, as indicated in step 3:7, and in case of a failed scanning, as indicated in step 3:8, an alarm is activated at the user device 130, according to steps 3:9*a*-3:10.

If instead, as indicated in FIG. 3*b*, the property device 110 is informed in step 3:6*b*' that the short range capabilities of the user device 130 were already active when the message of step 3:4*b* was received, the property device 110 will be able to rely fully on the result of the first failed scanning. In this case the property device 110 responds to receiving such a message by activating the alarm at the user device 130, as indicated with steps 3:7*a*' and 3:7*b*', followed by steps 3:8' and 3:9'.

Alternatively, a response message indicating to the property device 110 that the short range capabilities were already active upon receiving a message requesting for verification of the short range capabilities of the user device 130 may only be provided to the property device 110 in case it is verified at the user device 130 that the short range capabilities were active a certain predefined time interval before receiving the message from the property device 110, thereby further assuring that the short range capabilities were active not only upon receiving the message from the property device 110, but also during the complete scanning executed by the property device 110.

Two alternative methods executed at a user device being registered at a property device, such that movement of the property device which is out of an allowed range of the user device will result in an alarm at the user device will now be described in further detail, executed according to the two alternative methods described above, with reference to FIGS. 3*a* and 3*b*, will now be described in respective flow charts with reference to FIGS. 4*a* and 4*b*, respectively.

Figure 4A:
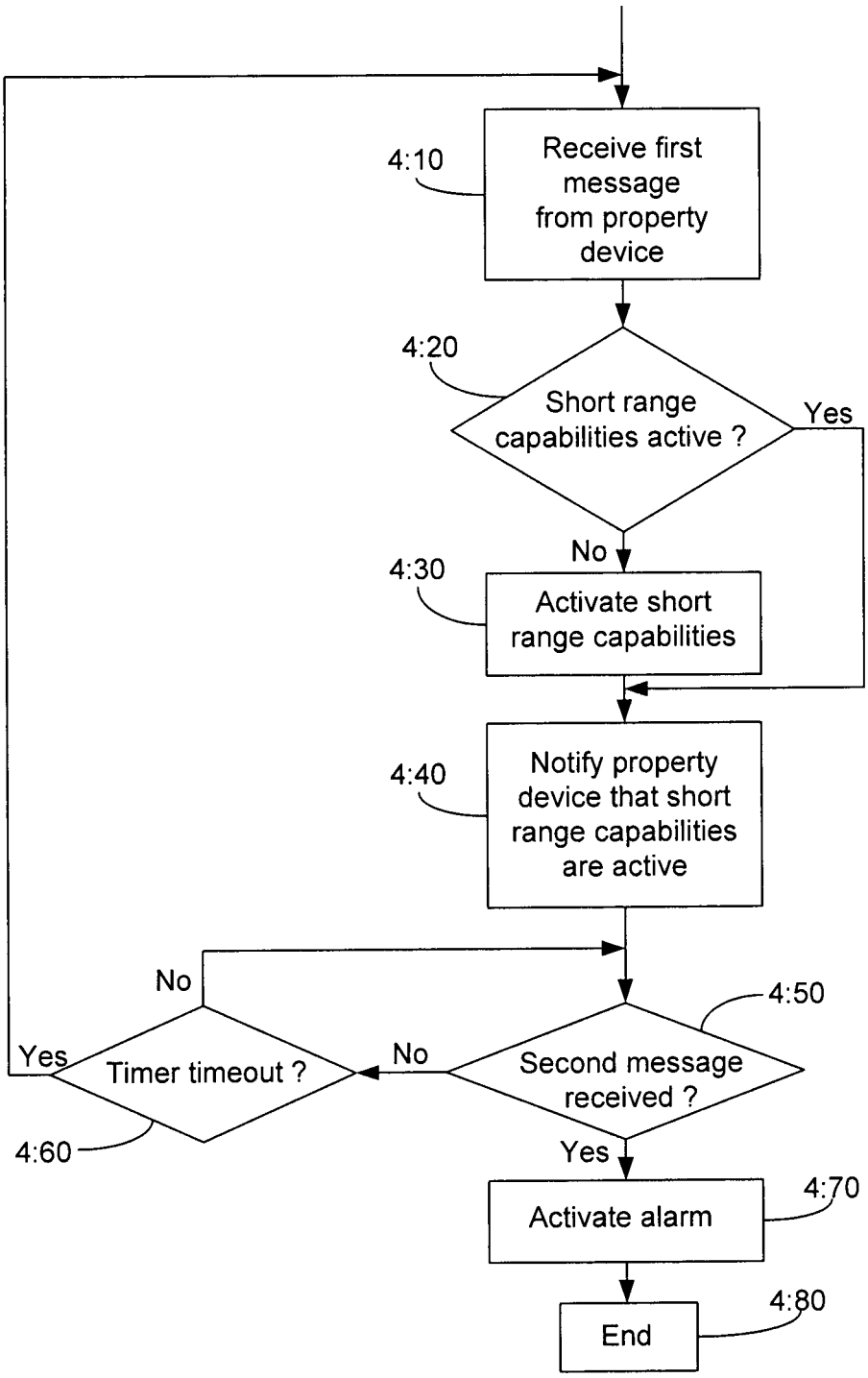
FIG. 4*a* is a flow chart illustrating a method, executed on the user device, of verifying movement of a property device, according to one embodiment.
Figure 4B:
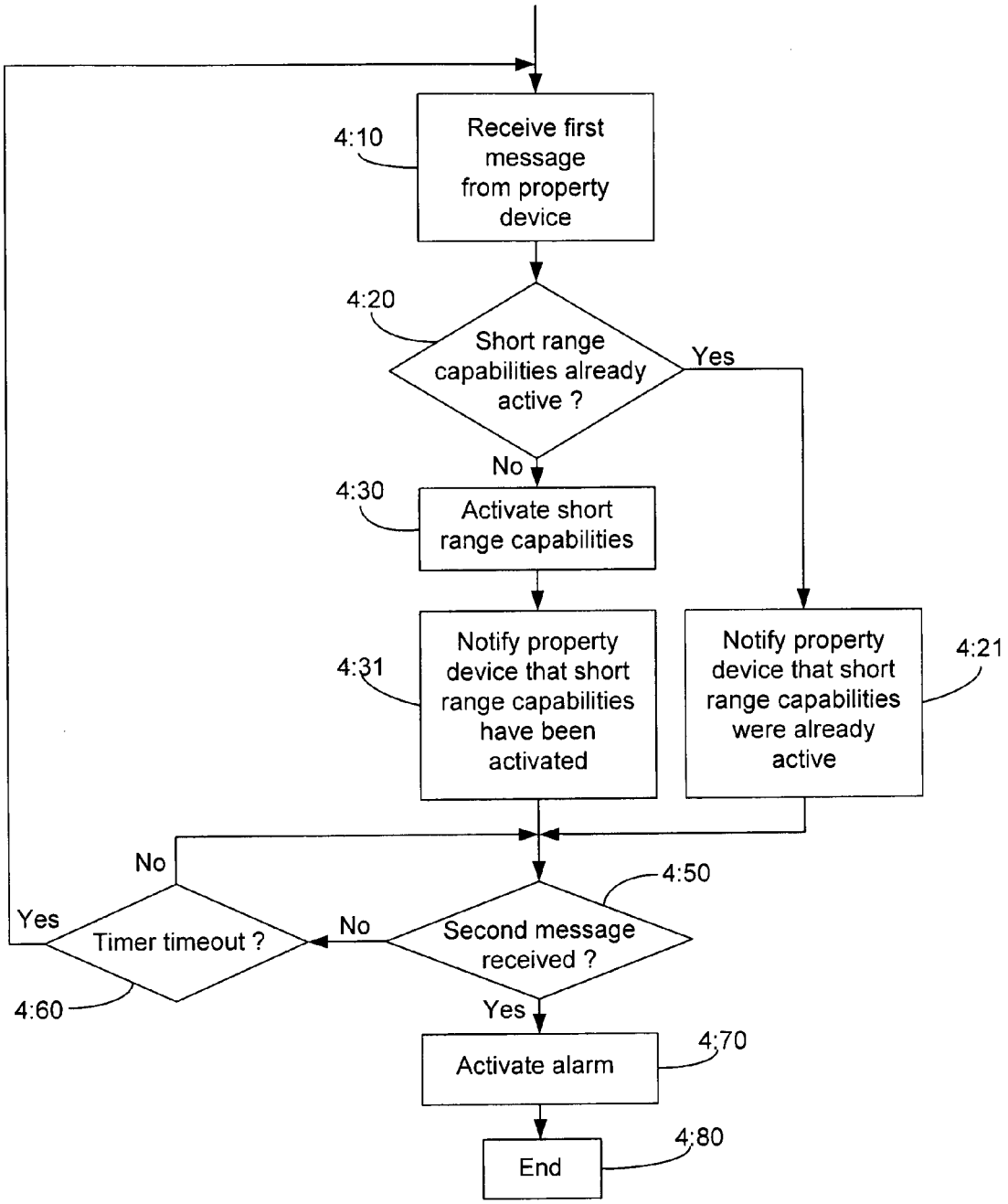
FIG. 4*b* is a flow chart illustrating a method, executed by the user device, of verifying movement of a property device, according to another embodiment.

Starting with FIG. 4*a*, the method is initiated at the user device, receiving a first message from a property device via a wireless wide range connection. The massage is recognized by the user device as a request for verification of short range capabilities of the user device, as indicated in step 4:10. In a next step 4:20 it is determined whether the short range capabilities of the user device are already active. As indicated above, this check may alternatively include determination as to whether or not the short range capabilities have also been active for the duration of a scanning executed and terminated at the property device. If the short range capabilities were already active upon receiving the first message, the property device is notified of this in a response message, which is also sent via a wireless wide range connection, as indicated in a subsequent step 4:40, while if it is determined that the short range capabilities were not active upon receiving the first message, the short range capabilities of the user device are first activated, as indicated in a step 4:30, before the response message is sent to the property device in step 4:40. Consequently, identical response messages, having the sole purpose of verifying that the short range capabilities of the user device are active when the response message is sent from the user device, will be sent to the property device in both scenarios.

The process described above continues when the user device receives a second message from the property device, as indicated in a next step 4:50. This event occurs when the property device has experienced a second failed scanning for the user device and responds by transmitting a second message to the user device. The user device will allow a time interval to pass which is enough for the property device to perform a second scanning and for the user device to receive the second message. Such a condition is illustrated with step 4:60, where the alarm activation process is terminated at the user device if no second message has been received when the timer has reached its limit. In the latter case, it is assumed that the second scanning was successful within the specified time limit, and thus, that no second message is to be expected from the property device.

As indicated in FIG. 4*a*, the process will again be initiated, starting at step 4:10 when a new first message is received from the property device, due to a new movement detected at the property device.

On the other hand, once a second message is received by the user device, prior to a timer timeout at step 4:60, the user device responds by activating an alarm, as indicated in step 4:70. As already mentioned, the alarm activation may include activation of one or more alerting functions at the user device and/or any connected device/s, which are capable of alerting a user in a suitable way.

Another method where a user device is capable of providing more detailed response messages to a property device, is described with reference to FIG. 4*b* where step 4:40 of FIG. 4*a* is replaced by alternative steps 4:21 or 4:31 in FIG. 4*b*. If, in step 4:20 of FIG. 4*b* it is determined that short range capabilities of the user device were already active upon receiving the first message from the property device, the user device provides a response message to the property device, indicating this to the property device, as indicated in a step 4:21.

If, on the other hand it is determined in step 4:20 that the short range capabilities were not active upon receiving the first message, the short range capabilities are activated, as indicated in step 4:30, and a response message, indicating to the property device that the short range capabilities have been activated in response to receiving the first message, is sent to the property device, as indicated in a subsequent step 4:31. Once the response message has been sent to the property device, steps which correspond to steps 4:50-4:70 of FIG. 4*a* are executed. As already mentioned above, a more detailed response message will allow alternative approaches to be applied on the property device.

A method to be executed at a property device applying a static response message, i.e. the response message will always have the same content, will be described below with reference to FIG. 5*a*, where the method is triggered by the property device, recognizing movement, as indicated in a first step 5:10. The property device responds to such a trigger by initiating a first scanning for a user device which has been registered at the property device, as indicated in a next step 5:20. Typically a user has selected one or more user devices which are considered suitable for maintaining in close vicinity of the property device, and registered this/these user device/s at the property device. Alternatively, one or more user devices may be registered at a property device on a permanent basis, i.e. if purchased together as a co-operating set of devices.

The initiated first scanning is continued for the duration of a predetermined time interval, as indicated in step 5:40 if the user device which has been scanned for is not found before timer timeout, i.e. before the end of the predetermined time interval. If, however, the user device is found during the scanning, i.e. the scanning for the registered user device is successful, the method is terminated. When a new movement of the property device is recognized, the process may start again unconditionally at step 5:10. Alternatively, the triggering of a new process at step 5:10 may require that a certain re-activation activity is first triggered at the property device, as indicated with the optional step 5:31. Such a re-activation may e.g. include that a car having a property device attached to or placed in it is unlocked, electronically or mechanically by a user. In such a case, the property device may either be directly connected to an electronic or mechanical lock, or be connected to sensing means which is capable of sensing whether the car is locked or unlocked.

If the scanning initiated in step 5:20 has not resulted in any successful scanning upon timer timeout, the property device generates a first message, having the purpose of verifying that short range capabilities are active at the user device, and provides it to the user device, as indicated in a step 5:50. This first message is sent via a wireless wide range connection which is set up by the property device either directly with the user device, or via an alarm control server, or any intermediate node.

After the user device has responded to the first message by activating the short range capabilities of the user device and assembled and sent a response message to the property device via a wireless wide range connection, this message is received by the property device, as indicated in step 5:60. The property device responds to reception of the response message, by initiating a second scanning for the user device, as indicated in step 5:70. The same procedure as for the first scanning, i.e. according to steps 5:30 and 5:40 is now executed, as indicated with steps 5:80 and 5:90.

If during the second scanning the user device scanned for is found, i.e. the scanning is successful, the process is terminated and halted until a new movement is recognized at the property device, when a new process is initiated, starting with step 5:10. Optionally a new process requires that a re-activation has been triggered, according to step 5:81, corresponding to step 5:31.

If instead the second scanning is unsuccessful, an alarm is activated at the user device, as indicated in a step 5:100, by transmitting a message comprising such an instruction via a wireless wide range connection. Alternatively, the property device may also activate a control mechanism, as indicated in an optional step 5:110, where the control mechanism will provide improved security by enabling automatic in-activation of one or more functions of the property device and/or the device on which the property device is attached or located.

An alternative method to be executed by the property device where more detailed response messages are applied will now be described with reference to FIG. 5*b*, thereby avoiding execution of a second scanning when such a repeated scanning is found not to be necessary. In FIG. 5*b* the initial steps 5:10-5:60 are the same as described in FIG. 5*a*. In addition, steps 5:80 and 5:81 are identical in both methods. What differs between the two embodiments is how the response message is interpreted in step 5:61. If the response message received in step 5:60 indicates that the short range capabilities of the user device have not been activated by the property device in response to receiving the first message from the property device, since they were already active, as indicated with branch B of step 5:61, an alarm is activated at the user device, by transmitting a second message via a wireless wide range connection, as indicated in step 5:100, without executing any second scanning.

As has already been mentioned above, a property device may have been preconfigured to scan for a plurality of user devices, and, if so, parallel processes according to any of the processes described above, with reference to FIG. 5*a* or 5*b* will be executed, such that each user device for which one or two scanning procedures, depending on the embodiment, has been unsuccessfully executed can be instructed to initiate an alarm.

Figure 5A:
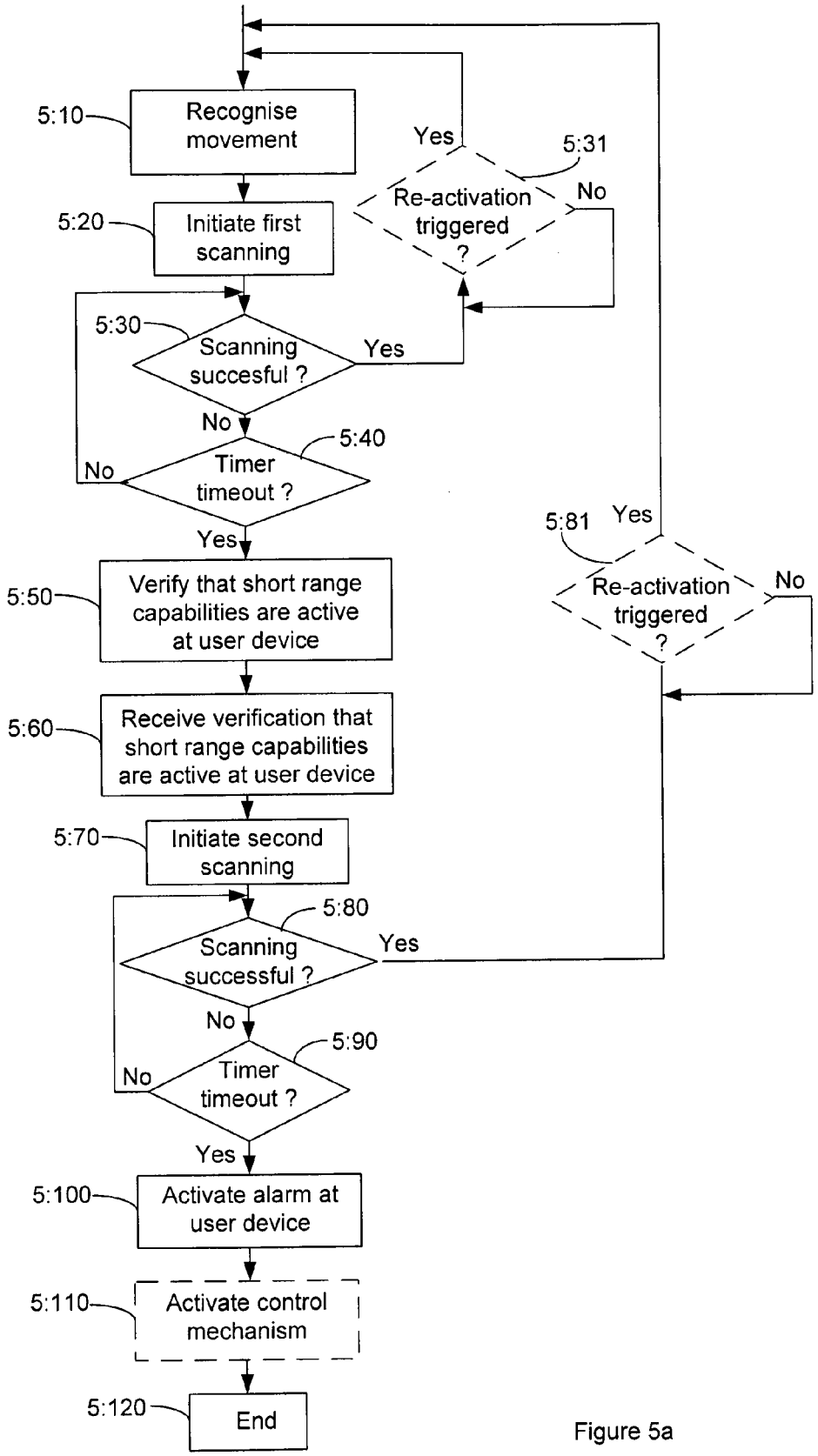
FIG. 5*a* is a flow chart illustrating a method, executed by the property device, of notifying a user device of movement of the property device, according to one embodiment.
Figure 5B:
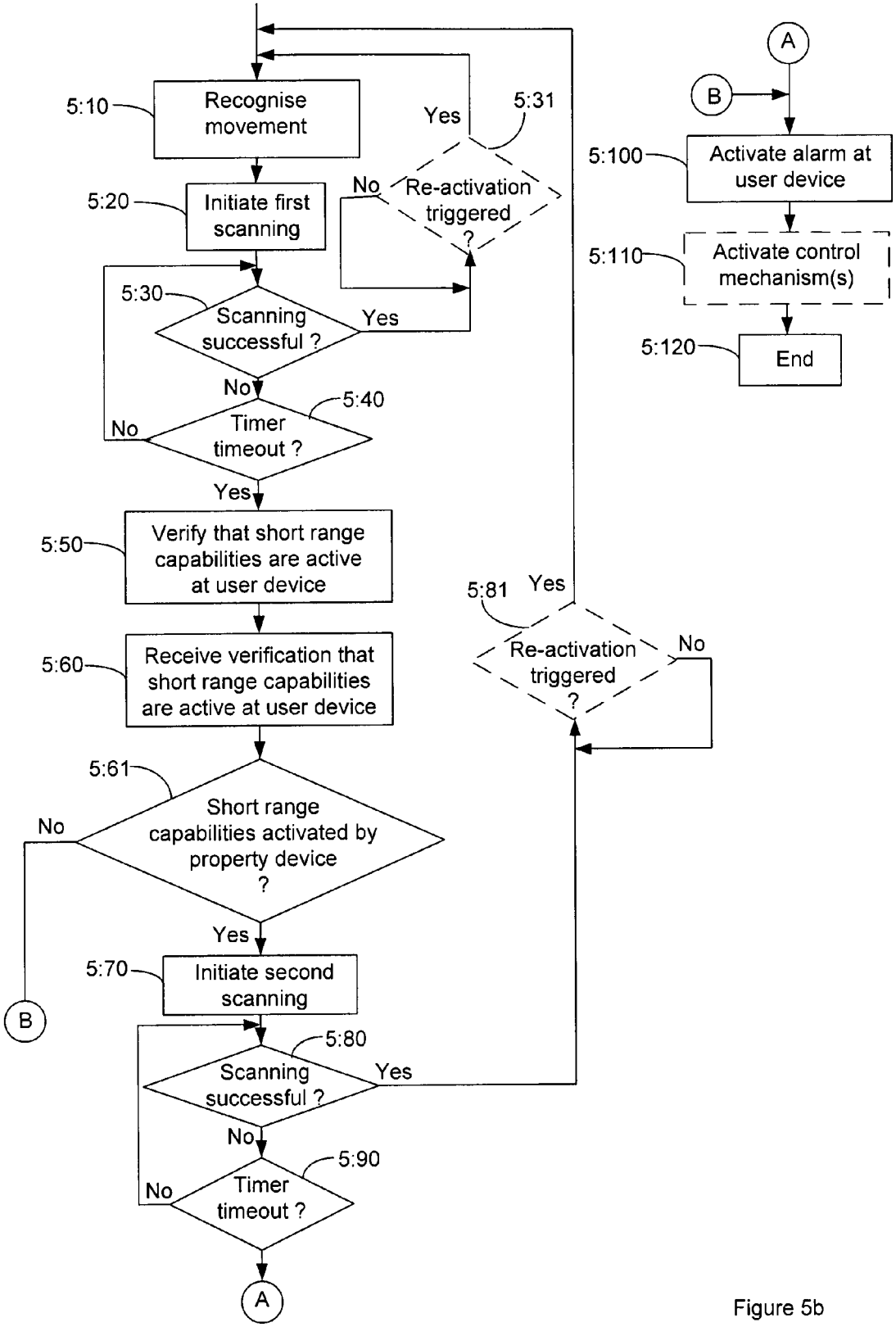
FIG. 5*b* is a flow chart illustrating a method, executed by the property device, of notifying a user device of movement of the property device, according to another embodiment.
Figure 5C:
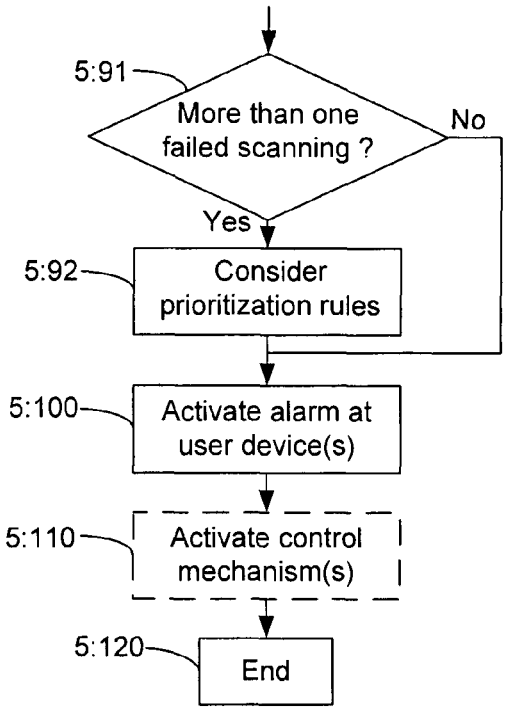
FIG. 5*c* is an alternative flow chart illustrating how scanning processes executed according to any of the methods of FIG. 5*a* or FIG. 5*b* may be evaluated at the property device in case a property device is scanning for a plurality of user devices.

Alternative method steps, where a plurality of user devices are being scanned, is illustrated in FIG. 5*c*, where according to step 5:91, which is supposed to follow subsequent to step 5:90 of FIG. 5*a* or 5*b*, respectively, it is determined if more than one scanning has failed. If this is the case, predefined prioritization rules may be used to determine a specific preferred order in which to activate an alarm at respective registered user devices for which the scanning has failed. Such prioritization rules may e.g. specify that, depending on the time of the day or the present situation, different user devices shall be instructed to initiate an alarm. During a meeting a device set to activate a silent alarm may e.g. be preferred compared to a user device set to activate a sound alarm. In case of prioritization rules, such rules may be applied in a corresponding way already after a first scanning, i.e. in association with step 5:40.

The property device used for detecting movement of a portable device to which it is attached or in which it is placed may e.g. be configured as any type of device having short range or middle range capabilities, as well as wireless wide range capabilities, as defined in this document, and access to some type of movement sensing functionality. The property device may e.g. be a programmable System on Chip (SoC) which may be attached to or placed in various types of portable devices, or it may be an integrated part of another portable device, such as e.g. a mobile phone or an Android platform device. Any of the latter alternatives may be preferred if the property device is to be easily movable between different devices for which protection is desired.

Figure 6:
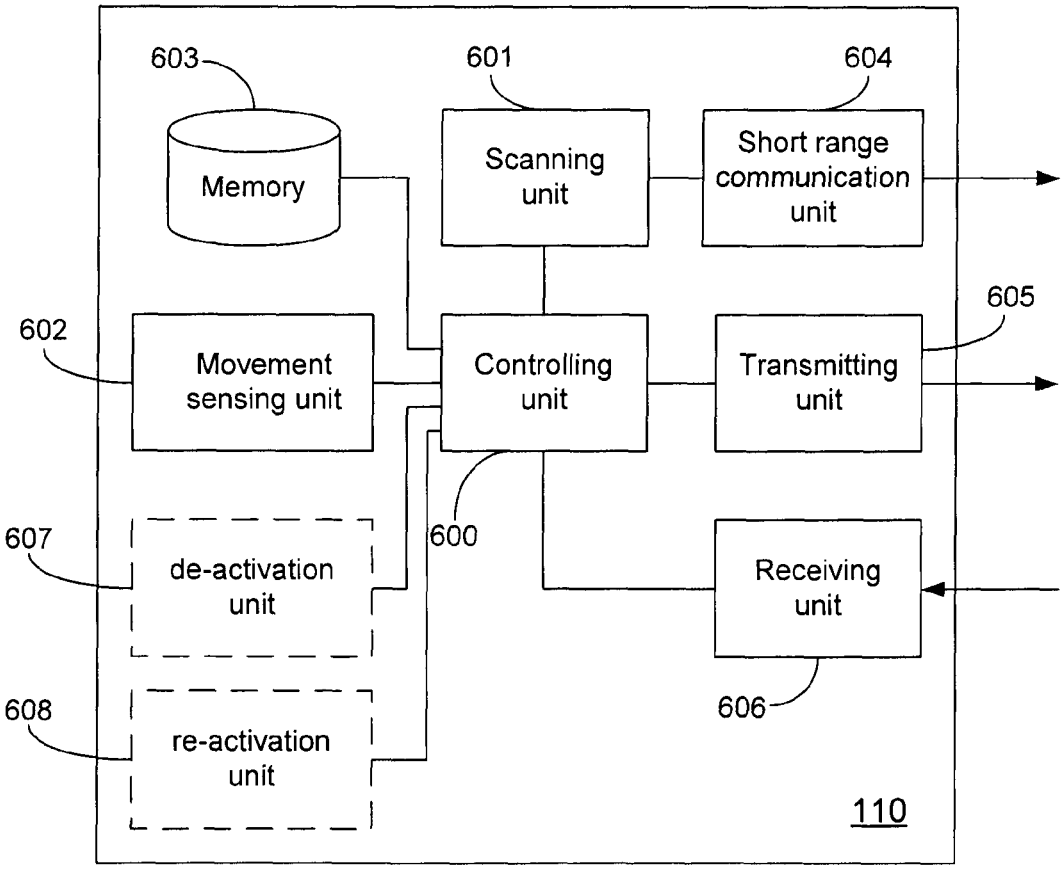
FIG. 6 is a block scheme illustrating a property device capable of sensing movement of the property device and of reporting the movement to a user device, according to one embodiment.

A simplified block scheme of a property device according to one embodiment will now be described in further detail with reference to FIG. 6 where the property device 110 comprises a controlling unit 600 which is arranged such that it activates a scanning unit 601 to execute a scanning for one or more registered user devices via a short range communication unit 604, when it receives an indication of movement of the property device from a movement sensing unit 602. Which user devices to scan for may be determined by interrogating a list stored in a memory 603, which may also comprise prioritizing rules, specifying in which order and/or under which conditions to involve respective registered user devices in the described movement alarm process.

The scanning unit 601 is configured to execute each initiated scanning for a certain pre-determined time interval, in order to assure that a serious attempt to verify whether or not a user device (not shown) scanned for is located within range of the short range communication unit 604, unless the user device scanned for is found during the scanning. In the latter case, the controlling unit 600 is configured to terminate the process, which may be initiated once again when a new movement is detected. Alternatively, the controlling unit 600 is configured to repeat the movement alarm process only when a re-activation activity has been recognized by an optional re-activation unit 608. Such a re-activation unit 608 may be configured to recognize a re-activation activity executed on the property device, e.g. a code entered on a keyboard (not shown) of the property device, or on another device connected to the property device, e.g. unlocking of a car lock, or any other function previously de-activated automatically by the property device or manually by a user.

If a plurality of user devices are to be scanned for according to the stored list, the controlling unit 600 is configured to initiate separate parallel scanning processes for each user device, such that an initiated movement alarm process is allowed to be completed only if it is verified that at least one scanning for a registered user device has failed.

The controlling unit 600 is also configured to verify that short range capabilities are active at the user device by transmitting a message requesting for such a verification via a transmitting unit 605 and a wireless wide range connection, set up between the property device 110 and the user device. More specifically, the controlling unit 600 is configured to transmit a message, e.g. in the form of an SMS, to a registered user device (not shown) for which a scanning has failed, by using its short range capabilities. As indicated above such a message will trigger the user device to activate yet un-activated short range capabilities of the user device, if this is the case, and respond by transmitting a response message to the property device 110 to verify the short range capabilities are now active.

The property device 110 also comprises a receiving unit 606, capable of receiving the response message from the user device, and the controlling unit 600 is configured to initiate a second scanning, in response to receiving such a response message. Alternatively, the controlling unit 600 is instead configured to initiate a second scanning only if it is verified in the response message that the short range capabilities of the user device were not active when the initial message from the property device was received by the user device, i.e. the first scanning for the user device could under no circumstances have been executed.

Irrespective of what type of response message that is applied, the controlling unit 600 is configured to respond to reception of a response message from the user device via the receiving unit 606 and a wireless wide range connection, by transmitting a second message to the user device via the transmitting unit 605 and a wireless wide range connection, instructing the user device to initiate an alarm at the user device to alert a user of the user device that the property device has now been moved further away from the user device than accepted.

Optionally, the controlling unit 600 may also be configured to instruct a de-activation unit 607, to lock, disable or turn off one or more functions of the property device 110 and/or the portable device to which the property device 110 is attached or on which it is located, in association with instructing the user device to initiate the alarm, thereby prohibit a fraudulent user to be able to use the property device 110 and/or the device to which the property device is attached. The controlling unit 600 may be configured such that a function which has been locked, disabled or turned off by the de-activation unit 607 may later be re-activated via a re-activation unit 608, either remotely, or on the spot, e.g. by sensing manually entering of a code into a UI (not shown) or manually mechanical unlocking of a lock, or an automatic re-activation.

A user device which is to be used for alerting a user of unwanted movement of a property device may be a mobile user device, such as e.g. an mobile phone, typically an Android smart phone or any other type of smart phone, a lap top, a Tablet, a stationary user device, such as e.g. a PC, or any type of user device with is capable of supporting short or middle range capabilities suitable for being responsive to scanning initiated at the property device, and long range wireless capabilities. A simplified block scheme of a user device according to one embodiment will now be described in further detail below, with reference to FIG. 7.

Figure 7:
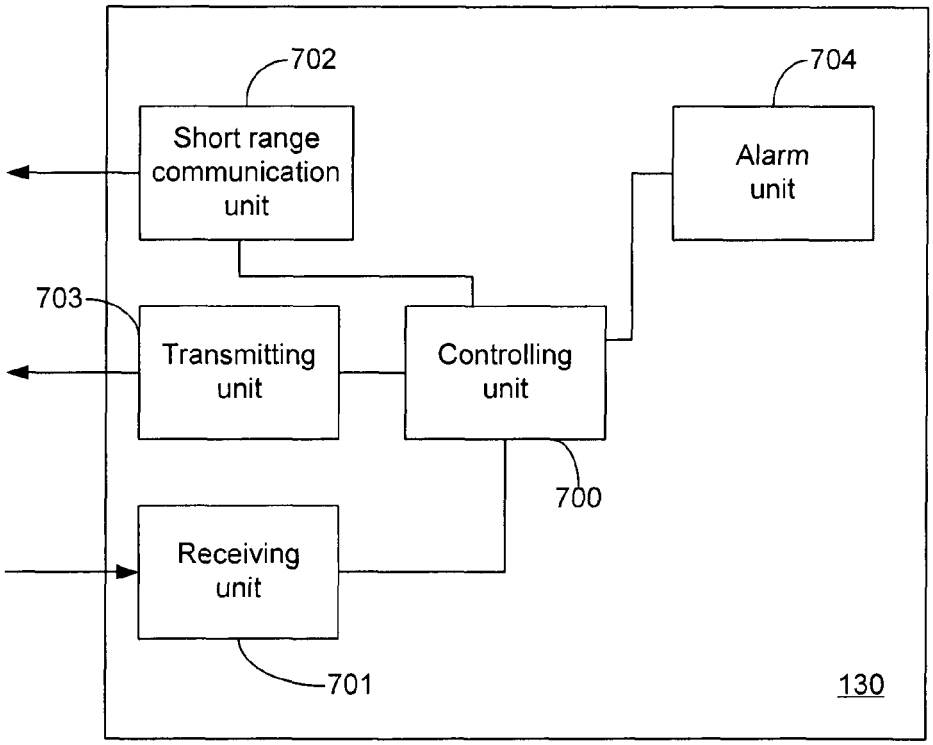
FIG. 7 is a block scheme illustrating a user device, capable of notifying a user of a movement of a property device, according to one embodiment.

The user device 130 of FIG. 7 comprises a controlling unit 700 which is configured to respond to reception of a message received via a receiving unit 701 and a wireless wide range connection from a property device (not shown) to which the user device has been registered, by activating a short range communication unit 702, in case short range capabilities provided by the short range communication unit 702 are not already active. In the latter case these capabilities are maintained unchanged. In any event the controlling unit 700 is configured to respond to reception of the message from the property device by transmitting a response message to the property device, via a transmitting unit 703 and a wireless wide range connection, thereby verifying to the property device that, at least from now on, the short or middle range capabilities are active.

Alternatively, the controlling unit 700 is configured to generate a more detailed response message, which when sent to a property device via the transmitting unit 703 will indicate to the property device either that the short range capabilities were already active when the message was received from the property device, or that the short range capabilities were activated in response to receiving that message from the property device. The controlling unit 700 is also configured to activate an alarm unit 704 arranged on the user device 130 as indicated in the figure by activating any type of visual or audio means, alone or in a combination. Alternatively, or in combination, one or more external units (not shown) capable of operating as an alarm may be connected to the user device 130, wherein the controlling unit 700 is configured also to activate one or more external alarm unit.

In accordance with what has been mentioned above, the controlling unit 700 may be configured to determine not only whether or not the short range capabilities were active upon receiving a message from the user device, but whether or not these capabilities were active also a predefined time interval before receiving such a message, i.e. by the time when a scanning was executed by the property device from which the message is received.

Figure 8:
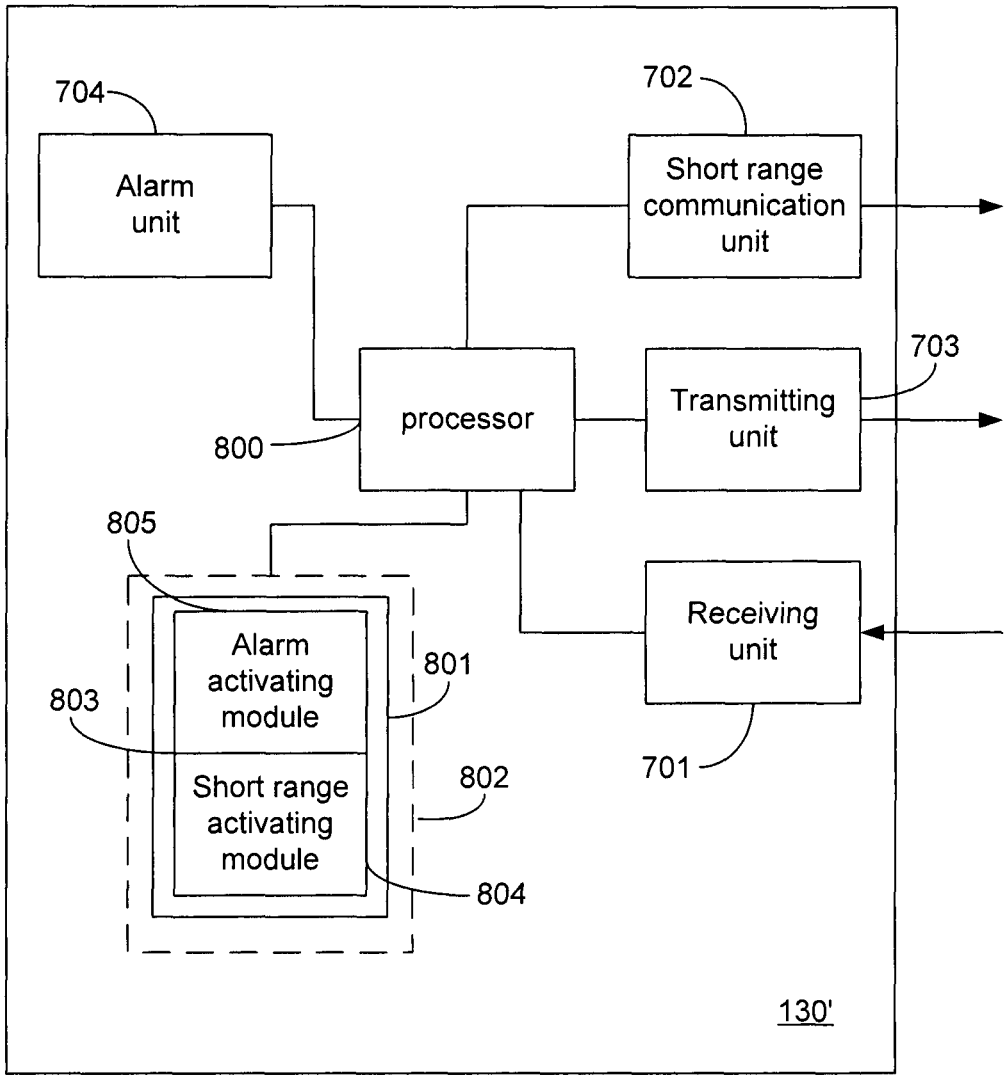
FIG. 8 is block scheme illustrating a user device capable of sensing and reporting movement of a property device, according to another embodiment.

The functionality described above may alternatively be realized by initiating an application or a computer program executable on the user device. Such a computer program may be provided in the form of source code, object code, or in some intermediate form. Such an alternative user device 130' is illustrated in FIG. 8, which shows a user device 130', where user device 130' may be referred to as a computer comprising a combination of hardware based units, such as the receiving unit 701, short range communication unit 702, transmitting unit 703 and alarm unit 704, and software based functionality, stored in a memory 801 as computer readable instructions of a computer program 803, which when executed by a processor 800 causes the processor 800 to activate functionality corresponding to the functionality described above with reference to FIG. 7. The processor 800 may e.g. be a DSP (Digital Signal Processor) or a CPU (Central Processing Unit). Alternatively, processor 800 may be replaced by a plurality of processors, configured to interact accordingly. The computer program 803 may be arranged such that it is forming part of a computer program product 802 together with computer readable code means.

Figure 9:
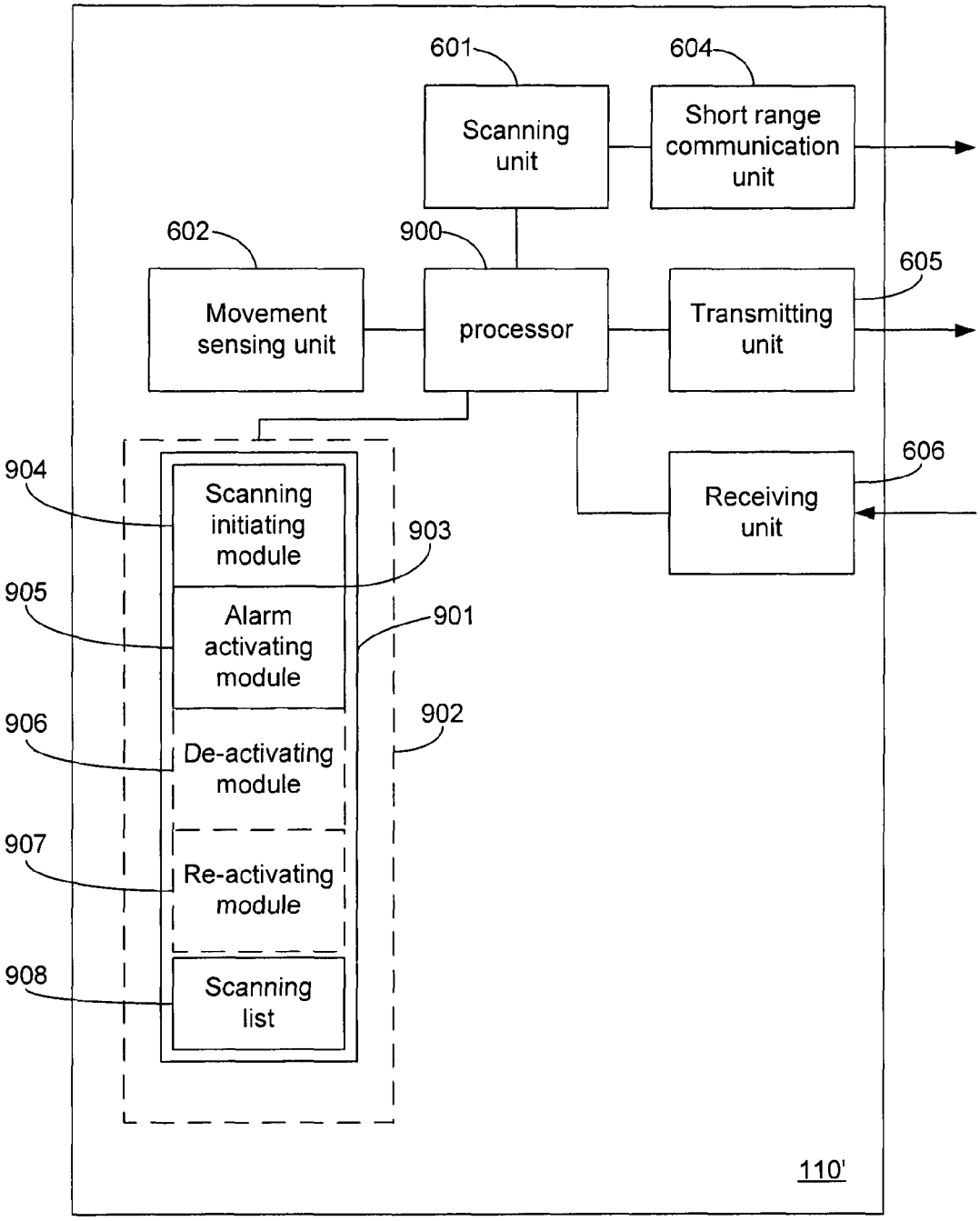
FIG. 9 is a block scheme illustrating a property device, capable of sensing movement of the property device and of reporting the movement to a user device, according to another embodiment.

In a corresponding way, a property device may alternatively be configured as a computer, comprising a combination of hardware and software, which is capable of executing an application or computer program available on the property device. Such an alternative property device 110' is illustrated in FIG. 9, where the property device 110' is arranged as a combination of hardware based functionality, such as the scanning unit 601, the movement sensing unit 602, the short range communication unit 604, the transmitting unit 605, and the receiving unit 606, which correspond to the corresponding units of FIG. 6, and software based functionality, stored in a memory 901 as computer readable instructions, which when executed by a processor 900 causes the processor 900 to activate functionality corresponding to the remaining functionality described with reference to FIG. 6. Also processor 900, may be e.g. a DSP (Digital Signal Processor) or a CPU (Central Processing Unit), and may alternatively be replaced by a plurality of interacting processors.

In FIG. 9 computer readable instructions are arranged as a computer program 903 which is here divided into four different modules, more specifically a scanning initiating module 904, an alarm activating module 905, a de-activating module 906 and a re-activating module 907. The computer program may be in source code form, object code form, or in some intermediate form, In addition, the program contains a list, here referred to as a scanning list 908, listing registered user devices. In addition, prioritization rules (not shown), as described above, may also be stored in the memory 901. The property device 110' may comprise a computer program product 902 comprising computer readable code means and the computer program 903.

Any of the computer program products mentioned above may comprise one or more computer-readable devices, firmware, programmable logic, memory devices, such as e.g., EEPROMs, ROMs, PROMs, RAMs, SRAMs, hardware, such as e.g. integrated circuit chip, Field Programmable Gate Array (FPGA), Application Specific Integrated Circuit (ASIC) or a computer readable non-volatile storage unit, such as e.g. e.g., a CD-ROM, floppy disk or a hard disk drive.

It is to be understood that the block schemes describing architectures of devices above are simplified block schemes which only comprise units and/or modules which are considered relevant for the understanding of the functionality described in the different embodiment. For simplicity reasons, conventional functionality which is normally also used in the described context, but which is not necessary for the understanding of the general concept described herein may have been omitted in the figures. It is also to be understood that names given to the interacting devices, units and modules are to be seen merely as non limiting examples, and that other devices, units and/or modules may be used instead as long as they are capable of providing corresponding functionality. The block schemes of FIGS. 8 and 9 may e.g. comprise other combination of hardware and software.

The invention claimed is:

1. A method executed in a first device for detecting a movement of a second device, comprising:

activating, by a processor of the first device, short or middle range capabilities at the first device, in case such capabilities are not already active, in response to receiving, by a receiver of the first device via a wireless wide range connection, a first message initiated at the second device to verify that the short or middle range capabilities are active at the first device;

transmitting, by a transmitter of the first device, to the second device, via the wireless wide range connection, in response to receiving the first message, a response message indicating that the short or middle range capabilities of the first device are active; and activating, by the processor of the first device, an alarm indicating the movement of the second device and that the second device is located out of range for the short or middle range capabilities of the first device, in response to receiving, by the receiver of the first device via the wireless wide range connection, a second message initiated at the second device and indicating a failed scanning for the first device by the second device.

2. The method according to claim 1, wherein the response message is indicating that the short or middle range capabilities were already active upon receiving the first message, or that the short or middle range capabilities have been activated in response to receiving the first message.

3. A computer program product, comprising a non-transitory computer readable code means and a computer readable code embedded thereon and configured to cause one or more processors to perform the method according to claim 1.

4. A method executed in a second device for indicating a movement of the second device at a first device, comprising:

recognizing, by a sensor of the second device, movement of the second device;

initiating, by a processor of the second device, a first scanning for a registered first device, using short or middle range capabilities, and, in case the first device is not found during the first scanning:

verifying active short or middle range capabilities at the first device, by transmitting a first message to the first device, by a transmitter of the second device via a wireless wide range connection, receiving, by a receiver of the second device via the wireless wide range connection, in response to the first message, a response message initiated at the first device, indicating that the short or middle range capabilities are active at the first device, initiating, by the processor of the second device, a second scanning for the first device, and initiating, by the processor of the second device, activation of an alarm at the first device by transmitting, by the transmitter of the second device via the wireless wide range connection, a second message to the first device, in case the first device is not found during the second scanning, thereby enabling a user of the first device to be notified of the movement of the second device where the second device is out of range for the short or middle range capabilities of the first device.

5. The method according to claim 4, wherein the second scanning is initiated at the second device and the activation of the alarm at the first device is initiated in case the first device is not found during the second scanning and in case it is indicated in the received response message that the short or middle range capabilities of the first device were activated by the first device in response to receiving the first message at the first device, or the activation of the alarm is initiated without initiating the second scanning in response to receiving the response message from the first device.

6. The method according to claim 5, wherein the method is terminated in case the first device is found during any executed scanning, and wherein said method is repeated upon recognizing another movement of the second device.

7. The method according to claim 6, wherein the method is repeated only upon recognizing the initiation of at least one predefined event prior to recognizing another movement.

8. The method according to claim 5, comprising the further step of:

activating a control mechanism to lock, disable, and/or turn off at least one function of the second device or of a device connected to the second device in association with transmitting the second message.

9. The method according to claim 5, comprising the further step of:

repeating each initiated scanning process for the registered first device by scanning for at least one additional first device.

10. The method according to claim 9, where in case more than one first device is not found during the executed scanning processes, whether or not to initiate activation of at least one alarm at a respective first device or what type of alarm(s) activation to initiate for a respective first device is determined on the basis of predefined prioritization rules.

11. A computer program product comprising a non-transitory computer readable code means and a computer program embedded thereon and configured to cause one or more processors to perform the method according to claim 4.

12. The method according to claim 1, wherein said messages are transmitted via an alarm control server.

13. A first device capable of detecting a movement of a second device, comprising:

a processor that activates short or middle range capabilities at the first device, in case such capabilities are not already active, in response to receiving, by a receiver of the first device via a wireless wide range connection, a first message initiated at the second device to verify that the short or middle range capabilities are active at the first device; and a transmitter that transmits, to the second device, via said wireless wide range connection, in response to receiving the first message, a response message indicating that the short or middle range capabilities of the first device are active, wherein the processor activates an alarm indicative of the movement of the second device and of a location of the second device which is out of range for the short or middle range capabilities of the first device, in response to receiving, by the receiver of the first device via the wireless wide range connection, a second message initiated at the second device and indicating a failed scanning for the first device by the second device.

14. The first device according to claim 13, wherein the transmitter provides the response message indicating that the short or middle range capabilities of the first device were already active upon receiving the first message, or that the short or middle range capabilities have been activated in response to receiving the first message.

15. A second device capable of indicating a movement of the second device at a first device, comprising:

a processor that:

causes a scanner to execute a first scanning for a registered first device using short or middle range capabilities, in response to receiving an indication of the movement of the second device, and in case the first device is not found during the first scanning, the processor verifies that short or middle range capabilities are active at the first device, by transmitting, by a transmitter of the second device via a wireless wide range connection, a first message to said first device, receives, by a receiver of the second device via said wireless wide range connection, in response to the first message, a response message initiated at the first device, indicating that the short or middle range capabilities are active at the first device, and causes the scanner to initiate a second scanning, and, in case the first device is not found during the second scanning, initiates activation of an alarm at the first device by transmitting, by the transmitter of the second device via the wireless wide range connection, a second message to the first device, thereby enabling a user of the first device to be notified of the movement of the second device when the second device is out of range for the short or middle range capabilities of the first device.

16. The second device according to claim 15, wherein the processor initiates the second scanning at the second device and initiates the activation of the alarm at the first device in case the first device is not found during the second scanning and in case it is indicated in the received response message that the short or middle range capabilities of the first device were activated by the first device in response to receiving the first message at the first device, or initiates the activation of the alarm without initiating the second scanning in response to receiving the response message from the first device.

17. The second device according to claim 16, wherein the processor terminates said process in case the first device is found during any executed scanning, and to repeat said process upon recognizing initiation of at least one predefined event.

18. The second device according to claim 16, wherein the processor activates a control mechanism to lock, disable, and/or turn off at least one function of the second device or of a device connected to the second device in association with initiating the activation of the alarm.

19. The second device according to claim 16, wherein the processor repeats each initiated scanning process by initiating a scanning process for at least one additional first device.

20. The second device according to claim 19, Where in case more than one first device is not found during the executed scanning processes, the processor determines whether or not to activate an alarm for a respective first device which was not found on the basis of predefined prioritization rules.

21. The second device according to claim 16, wherein the processor sets up the wireless wide range connection via an alarm control server.

22. A movable device comprising a second device according to claim 16.

23. A first device capable of detecting a movement of a second device, comprising:

a processor; and a non-transitory memory capable of storing instructions which when executed by the processor causes the processor to:

activate short or middle range capabilities at the first device, in case such capabilities are not already active, in response to receiving, by a receiver of the first device via a wireless wide range connection, a first message initiated at the second device to verify that the short or middle range capabilities are active at the first device, transmit, by a transmitter of the first device, to the second device, via the wireless wide range connection, in response to receiving the first message, a response message indicating that the short or middle range capabilities of the first device are active, and activate an alarm, indicative of the movement of the second device and of a location of the second device which is out of range for the short or middle range capabilities of the first device, in response to receiving, by the receiver of the first device via the wireless wide range connection, a second message initiated at the second device and indicating a failed scanning for the first device by the second device.

24. A second device capable of indicating a movement of the second device at a first device, comprising:

a processor; and a non-transitory memory capable of storing instructions which when executed by the processor causes the processor to:

cause a scanner to execute a first scanning for a registered first device using short or middle range capabilities, in response to receiving an indication of the movement of the second device and, in case the first device is not found during the first scanning:

verify that short or middle range capabilities are active at the first device, by transmitting, by a transmitter of the second device via a wireless wide range connection, a first message to the first device, receive, by a receiver of the first device via the wireless wide range connection, in response to receiving the first message, a response message initiated at the first device, indicating that the short or middle range capabilities are active at the first device, cause the scanner to initiate a second scanning, and, in case the first device is not found during the second scanning:

initiate activation of an alarm at the first device by transmitting, by the transmitter of the first device via the wireless wide range connection, a second message to the first device, thereby enabling a user of the first device to be notified of the movement of the second device when the second device is out of range for the short or middle range capabilities of the first device.

* * * * *